US011583039B2

(12) United States Patent
Emonin

(10) Patent No.: US 11,583,039 B2
(45) Date of Patent: Feb. 21, 2023

(54) DEVICE FOR ADJUSTING AND CLAMPING A STRAP

(71) Applicant: ZEDEL, Crolles (FR)

(72) Inventor: Simon Emonin, Grenoble (FR)

(73) Assignee: ZEDEL, Crolles (FR)

( * ) Notice: Subject to any disclaimer, the term of this patent is extended or adjusted under 35 U.S.C. 154(b) by 0 days.

(21) Appl. No.: 17/122,516

(22) Filed: Dec. 15, 2020

(65) Prior Publication Data

US 2021/0186164 A1 Jun. 24, 2021

(30) Foreign Application Priority Data

Dec. 19, 2019 (FR) ..... 1914824

(51) Int. Cl.
*A44B 11/18* (2006.01)
*A44B 11/12* (2006.01)

(52) U.S. Cl.
CPC ..... *A44B 11/18* (2013.01); *A44B 11/125* (2013.01); *Y10T 24/4086* (2015.01)

(58) Field of Classification Search
CPC ..... Y10T 24/4086; A44B 11/18
See application file for complete search history.

(56) References Cited

U.S. PATENT DOCUMENTS 2,119,469 A 5/1938 Kerngood
3,277,543 A * 10/1966 Gaylord ..... A44B 11/18 24/193
3,813,734 A * 6/1974 Schauweker ..... A44B 11/02 24/200
5,432,984 A 7/1995 Petzl
6,539,592 B1 * 4/2003 Choi ..... A44B 11/18 24/197
8,056,191 B2 * 11/2011 Crye ..... A44B 11/10 24/197
8,381,366 B2 2/2013 Hede et al.
(Continued)

FOREIGN PATENT DOCUMENTS

EP 2946682 A1 * 11/2015 ..... A44B 11/18
FR 1079133 A 11/1954
(Continued)

OTHER PUBLICATIONS

Translation of EP 2946682 A1 generated from Espacenet Dec. 2021 (Year: 2021).*

*Primary Examiner* — Robert Sandy
*Assistant Examiner* — Michael S Lee
(74) *Attorney, Agent, or Firm* — Oliff PLC

(57) ABSTRACT

The device for adjusting and clamping a strap comprises superposed first and second rings to define a slot for the strap to pass through. The second ring presses on the first ring. The slot for the strap to pass through is bounded by an outer edge of the second ring and an inner edge) of the first ring. The two rings are movable with respect to one another so that the slot for the strap to pass through is of variable thickness. A bottom surface of the first ring opposite the top surface of the first ring has a textured area provided with several salient elements designed to form an increased friction area between the strap and the bottom surface of the first ring. The textured area is separated from the outer edge of the second ring by the slot for the strap to pass through.

9 Claims, 2 Drawing Sheets

(56) References Cited

U.S. PATENT DOCUMENTS

| | | | | |
|---|---|---|---|---|
| 8,840,532 | B2 * | 9/2014 | Hetrick | A63B 21/1636<br>482/139 |
| 9,433,260 | B2 | 9/2016 | Hede et al. | |
| 2007/0187445 | A1 * | 8/2007 | Krapka | A44B 11/18<br>224/197 |

FOREIGN PATENT DOCUMENTS

| | | | |
|---|---|---|---|
| FR | 2996732 | A1 | 4/2014 |
| WO | 2005/009606 | A2 | 2/2005 |

* cited by examiner

DEVICE FOR ADJUSTING AND CLAMPING A STRAP

BACKGROUND OF THE INVENTION

The invention relates to a device for adjusting and clamping a strap and to a roping harness comprising one such device for adjusting and clamping a strap.

PRIOR ART

It is known to adjust the different straps of a roping harness by means of an adjustment device comprising a loop. The adjustment device is provided with a loop and is configured to perform adjustment of the strap to the desired length followed by clamping of the strap at said length so that the user can work under the optimal conditions.

Different adjustment and clamping device configurations have been tested and used. The devices presented in the documents U.S. Pat. Nos. 5,432,984, 8,381,366, FR 2,996,732 and U.S. Pat. No. 9,433,260 can be cited. In general manner, the adjustment and clamping device is formed by two superposed rings of rectangular shape. These two rings have different dimensions.

The bottom ring is larger than the top ring. The two rings are arranged to define a slot for the strap to pass through between the two rings. The two rings are fitted movable with respect to one another so as to be able to adjust the width of the pass-through slot. The strap passes round the top ring. Tightening of the strap results in closing of the pass-through slot clamping the strap in the required position.

However in use, when the strap is tensioned, it proves increasingly difficult to have an adjustment device that also performs clamping of the strap in position. The surface state of the straps changes with wear of the webbing so that the friction between the rings and strap is no longer sufficient to prevent the strap from sliding. Although it is always possible to shape the bottom ring so that it presents a rough edge ensuring a sufficient friction level for the strap to be properly secured, this solution is not acceptable as it will make the strap wear more quickly in the friction area which will be interpreted by the user as premature wear synonymous of a strap that is of poor quality or damaged.

It is therefore necessary to find another solution ensuring efficient securing of the tensioned strap in the desired position that is less sensitive to changes in the surface state of the strap. Improvement of the clamping quality must naturally not be achieved to the detriment of ease of adjustment.

OBJECT OF THE INVENTION

One object of the invention consists in providing a device for adjusting and clamping a strap that is more efficient than in the prior art without however impairing the ease of adjustment of the strap.

The device for adjusting and clamping a strap comprises a superposed first ring and second ring to define a slot for the strap to pass through, the second ring pressing on a top surface of the first ring, the pass-through slot of the strap being bounded by an outer edge of the second ring and an inner edge of the first ring. The first ring and second ring are movable with respect to one another so that the pass-through slot of the strap is of variable thickness, and the first and second rings are in a clamping position when the strap is tensioned or they are in a releasing position after a relative movement between the first and second rings whereby the thickness of the pass-through slot increases.

The adjustment and clamping device is remarkable in that a bottom surface of the first ring opposite the top surface of the first ring has a textured area provided with several salient elements designed to form an increased friction area between the strap and the bottom surface of the first ring, the textured area being separated from the outer edge of the second ring by the pass-through slot of the strap.

In one development, the first ring has a body extending in a first direction. The bottom surface is not flat and has at least first and second portions of surfaces that are not parallel and are separated by an inflection area. The textured area is formed on the first portion of surface, the second ring being pressing on the first ring opposite the second portion of surface, non-parallel first and second portions of surfaces being secant when they are extended towards one another.

In advantageous manner, the body of the first ring defines a V-shape or a U-shape in the cutting plane containing the first direction. The inner edge is extended by one of the inclined surfaces forming the V-shape or U-shape.

In a particular configuration, the first portion of bottom surface defines a depression directed towards the top surface, the textured area being located between the inner edge and the depression.

In an advantageous embodiment, the textured area has salient elements configured to sink into the strap.

It is also advantageous to provide for the salient elements to be located at a first distance from the inner edge, the first distance being not zero and less than twice the thickness of the first ring.

Preferentially, at least a part of the salient elements is formed by gripping spikes.

In another configuration, at least a part of the salient elements is formed in the bulk of the first ring.

It is further advantageous to provide for at least a part of the salient elements to be formed from a material insert moulded on the first ring.

Preferentially, at least a part of the salient elements is formed on a support added onto the first ring and installed removably with respect to the first ring.

In a particular embodiment, the support at least partially covers the bottom surface of the first ring and forms a hook covering the inner edge and a part of the top surface.

It is a further object of the invention to provide an adjusting and clamping system that is more efficient than the prior art without however impairing the ease of adjustment of the strap.

The adjusting and clamping system is remarkable in that it comprises a device for adjusting and clamping a strap according to one of the foregoing configurations and a strap. The height of the salient elements is less than or equal to twice the thickness of the strap.

It is a further object of the invention to provide a roping harness at least one of the adjustment straps of which is better secured in the clamped position than the configurations of the prior art while remaining easy to adjust.

The roping harness is remarkable in that it comprises an adjusting and clamping system according to the foregoing configuration.

BRIEF DESCRIPTION OF THE DRAWINGS

Other advantages and features will become more clearly apparent from the following description of particular embodiments and implementation modes of the invention given for non-restrictive example purposes only and represented in the appended drawings, in which.

DESCRIPTION OF THE EMBODIMENTS

The device for adjusting and clamping a strap is mainly designed to be fitted on a roping harness in order to be able to adjust the effective length of the strap and to secure this strap at the required effective length.

Figure 1:
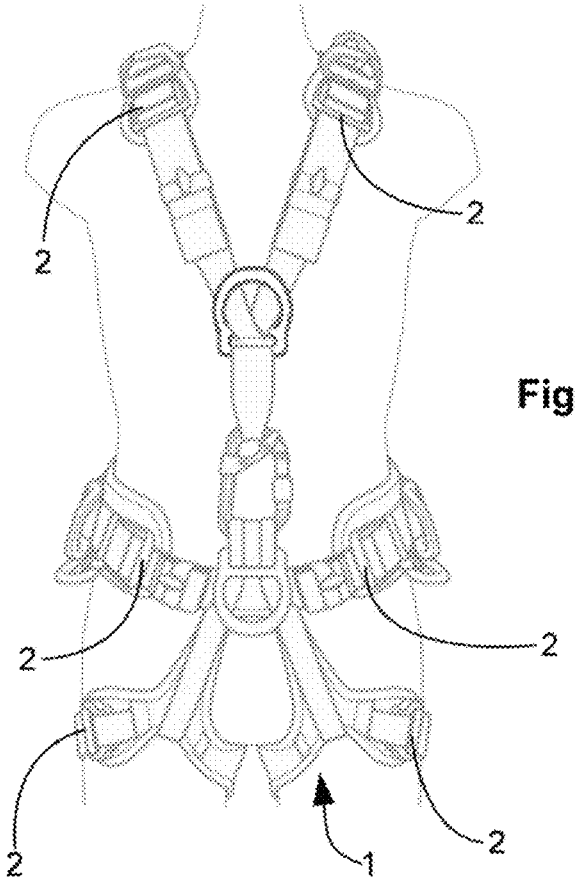
FIG. 1 schematically illustrates a roping harness equipped with devices for adjusting and clamping a strap according to the invention.

FIG. 1 schematically illustrates a roping harness 1 that can receive one or more devices for adjusting and clamping 2 a strap. As illustrated, device 2 for adjusting and clamping a strap can be fitted to adjust the length of the right shoulder strap, the left shoulder strap, the belt fitted around the waist, the right thigh strap or the left thigh strap. To perform adjustment of the belt, one or more devices 2 for adjusting and clamping a strap can be used.

Figure 2:
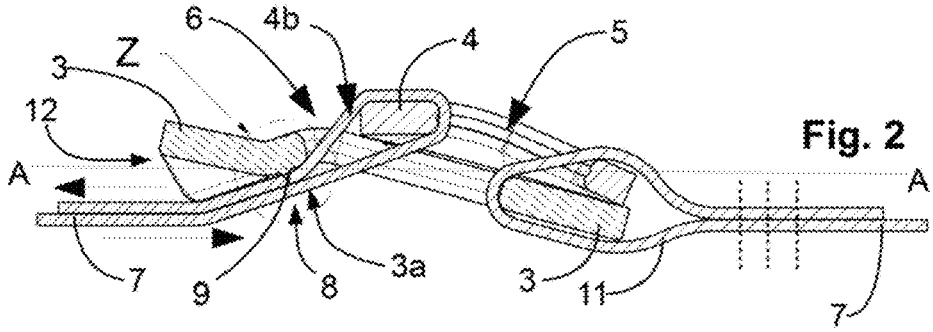
FIG. 2 schematically illustrates a device adjusting and clamping a strap with the top ring pressing on the bottom ring and the strap tensioned which tends to close the pass-through slot.
Figure 3:
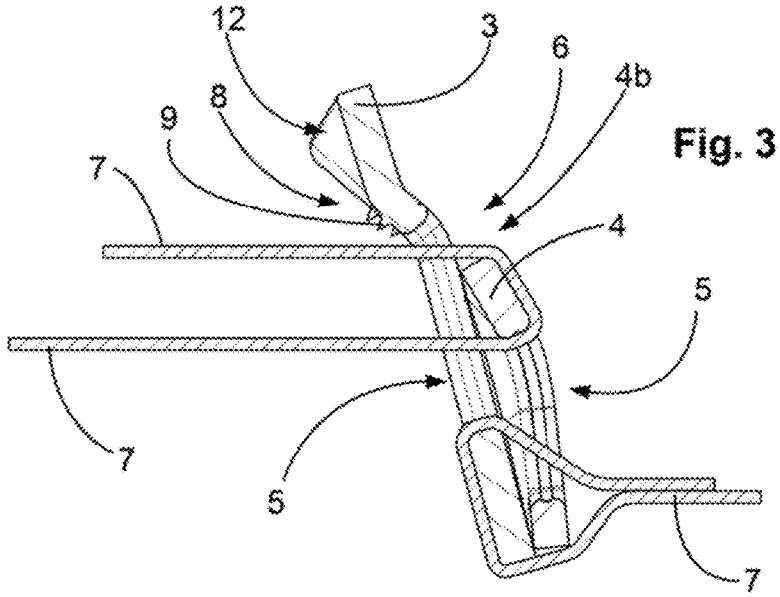
FIG. 3 schematically illustrates the adjusting and clamping device of FIG. 2 with the top ring pressing on the bottom ring and the strap tensioned. The device for adjusting and clamping a strap is shifted to eliminate the mechanical connection between the textured area and the strap to allow the strap to slide with respect to the rings.

As illustrated in FIGS. 2 and 3, adjustment and clamping device 2 comprises a first ring 3 and a second ring 4 superposed on one another. The two rings 3 and 4 each define a through hole 5. Each ring 3 and 4 has a body that passes round through hole 5 and has inner edges 3*a*/4*a* and outer edges 3*b*/4*b*. It is advantageous to form first ring 3 and second ring 4 from metal to ensure the strength of adjustment and clamping device 2 in the event of a fall.

The two rings 3 and 4 are offset from one another to define a slot 6 for passage of a strap 7 that has to be able to be adjusted to the desired length and secured at the required length. The two rings 3 and 4 can be of any shape—rectangular, square or trapezoid external shapes are possible. It is even possible to have rings having curved areas.

Pass-through slot 6 is bounded both by inner edge 3*a* of first ring 3 and by outer edge 4*b* of second ring 4 and more particularly by inner edge 3*a* of the bottom surface of first ring 3 and by outer edge 4*b* of the top surface of second ring 4. The two rings 3 and 4 are fitted movable with respect to one another so as to be able to adjust the width of pass-through slot 6 of strap 7, i.e. to adjust the distance between inner edge 3*a* of first ring 3 and outer edge 4*b* of second ring 4.

Through hole 5 can be of any shape. The same is the case for the outside of first ring 3 and second ring 4 which can be of any shape. However it is advantageous for through hole 5 of first ring 3 to have at least one flat surface. It is advantageous for the outer surface of second ring 4 to have a flat surface. It is then possible to form a slot having two flat and advantageously parallel opposite walls to have a maximum contact surface with the strap on the two opposite surfaces of the strap in the direction of its thickness. On its path through rings 3 and 4, the strap comes into contact with inner edge 3*a* of the bottom surface and with outer edge 4*b* of the top surface.

It is particularly advantageous for bottom inner edge 3*a* and top outer edge 4*b* to be rectilinear and for slot 6 to have a rectangular or substantially rectangular cross-section facilitating clamping of strap 7. The cross-section of slot 6 is observed with two opposite surfaces formed by inner edge 3*a* and outer edge 4*b*. The cross-section is also defined by two other opposite inner edges of through hole 5 of first ring 3.

First ring 3 can move with respect to second ring 4 so that the width of slot 6 is less than or equal to the thickness of strap 7 to clamp strap 7 between the two rings. Strap 7 extends in a longitudinal direction corresponding to the largest dimension of strap 7. The width and thickness of strap 7 are measured in directions that are perpendicular to one another and perpendicular to the longitudinal direction. The width corresponds to a larger dimension than the thickness. The width of slot 6 is measured along the same axis as the thickness of strap 7.

Each ring 3/4 extends in a direction AA and has opposite first and second ends in said direction. The first end of the two rings collaborates with strap 7 to perform adjustment and clamping of strap 7 at the required length. The second end of the two rings is associated with an attachment point, for example the second end of strap 7 or an anchor point of roping harness 1. The two rings 3 and 4 are kept secured, for example by means of a strap loop or any other means for securing to the second end.

First ring 3 can move with respect to second ring 4 in translation and in rotation to adjust the thickness of slot 6. Second ring 4 has a bottom surface that is pressing on a top surface of first ring 3. When strap 7 is pulled tight, strap loop 7 presses second ring 4 against the top surface of first ring 3. The strap pulls on the first end of second ring 4 to reclose slot 6.

Strap 7 passes round second ring 4 passing once through hole 5 of second ring and twice through hole 5 of first ring 3. Strap 7 exits from second ring 4 on outer edge 4*b* of the top surface to join first ring 3 on inner edge 3*a* of the bottom surface.

By applying a force on second ring 4 so that second ring 4 moves towards first ring 3, the thickness of slot 6 can be reduced. The force applied on second ring 4 correspond to a tensile stress between the two ends.

In the configurations of the prior art, the force applied on the strap has the effect of closing slot 6 and of clamping strap 7 between inner edge 3*a* and outer edge 4*b*. The value of the force applied to close slot 6 makes it all the more difficult for slot 7 to open and makes more difficult disturbance of the device for adjusting and clamping a strap. However the higher the force, the more strap 7 constricts the user which may be uncomfortable. The loop formed by the two rings 3 and 4 defines a clamping position when strap 7 is tensioned. Tensioning of strap 7 closes slot 6 until strap 7 prevents inner edge 3*a* from moving towards outer edge 4*b*.

To make it more complicated for the strap to become maladjusted, it is advantageous to use inner and outer edges of the second ring that are rough and/or at right angles to increase the friction when attempting to make strap 7 slide with respect to second ring 4. This configuration does however result in accelerated wear of the surface of strap 7 and a large variability of the clamping quality depending on the surface state of strap 7 (moisture, mud, ageing, etc.).

To make sliding of strap 7 with respect to first ring 3 and second ring 4 more difficult, the bottom surface of first ring 3 opposite the top surface of second ring 4 has a textured area 8. Textured area 8 has a plurality of salient elements 9 that come into contact with the strap. Salient elements 9 are arranged fixed on first ring 3 and more particularly on the bottom surface of first ring 3. The bottom surface of first ring 3 is designed to press against the user, on a support area of a harness or at least on two strands of strap 7 to be adjusted and clamped.

Textured area 8 is formed on the bottom surface of first ring 3, i.e. it is separated from second ring 4 by means of slot 6. Whereas the prior art configurations use a flat surface, it is particularly advantageous to form a textured area 8 ensuring that an increased friction is obtained between strap 7 and first ring 3. Textured area 8 is formed in the extension of slot 6 in the direction AA to come into contact with the strap. In advantageous manner, the textured area extends over at least 80% of the width of through hole 5 so as to be able to collaborate with a large part of the width of strap 7. Preferentially, textured area 8 extends over the whole width of the ring facing the through hole in the direction AA.

When strap 7 is tensioned during the adjustment phase, the two webbing straps defining the webbing loop that passes around second ring 4 are tensioned. Consequently, the webbing strap in direct contact with textured area 8 is pressed against the textured area by the other webbing strap. The tensile stress present in strap 7 presses the two strands of strap 7 against the bottom surface of first ring 3 and therefore against textured area 8. In the prior art configurations, strap 7 remains correctly adjusted due to the friction that exists between the strap and the different edges, i.e. on an extremely small surface. According to the invention, a textured area 8 can easily be had presenting a sufficiently large surface to clamp strap 7 in position.

Textured area 8 can be formed in different manners to increase the friction between first ring 3 and strap 7. Textured area 8 can be formed by patterns forming a wave, bars perpendicular to the direction AA, squares, triangles, rectangles, stars and any shapes that incite strap 7 to deform and therefore enhance friction. Preferably, the thickness of the texturing is at least equal to 0.5 mm and preferably between 0.5 mm and 2 mm.

Textured area 8 advantageously comprises a plurality of gripping spikes 9 that are configured to sink into strap 7. In preferential manner, gripping spikes 9 have a height that is less than or equal to the thickness of strap 7. It is also possible to have gripping spikes 9 having a height that is greater than the thickness of strap 6 and advantageously less than twice the thickness of strap 6. Gripping spikes 9 can be oriented in any direction. In advantageous manner, salient elements 9 are arranged at a first distance from inner edge 3*a*. The first distance is not zero and is less than twice the thickness of first ring 3.

Strap 7 is devoid of through holes passing through the whole thickness of strap 7.

Figure 6:
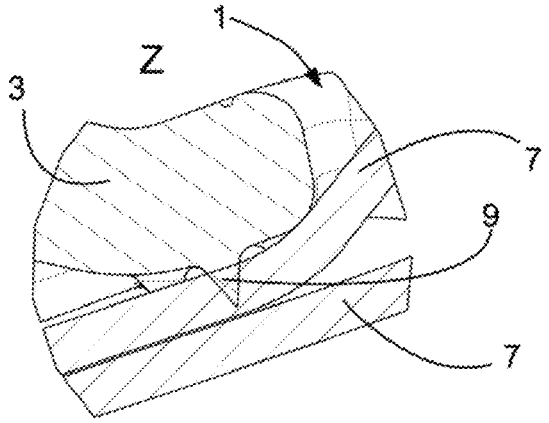
FIG. 6 schematically illustrates yet another embodiment of a bottom ring of a clamping device with a textured area insert moulded on the body of the bottom ring or formed in the bulk of the bottom ring.

In a particular embodiment, textured area 8 is defined in the bulk of first ring 3. For example, gripping spikes 9 are formed salient from the bottom surface of first ring 3 from the same material as the body of first ring 3. Such an embodiment is illustrated in FIGS. 2, 3 and 6. Gripping spikes 9 can be metal gripping spikes arranged salient from the metal body of first ring 3. FIG. 6 represents an enlarged view of FIG. 2 illustrating insertion of a gripping spike 9 in the thickness of one webbing strap 7 without reaching second webbing strap 7.

Figure 5:
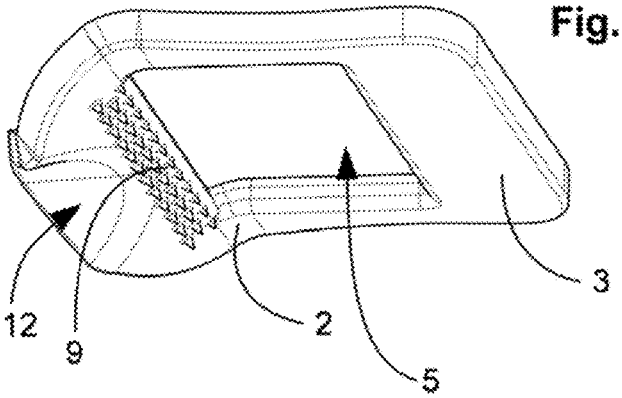
FIG. 5 schematically illustrates another embodiment of a bottom ring of a clamping device with a textured area arranged removably with respect to the bottom ring.

In another embodiment, textured area 8 is formed by insert moulding of a plastic material on the body of first ring 3. Textured area 8 is assembled irremovable from the body of first ring 3. Such an embodiment is illustrated in FIG. 5. In one particular case, the insert moulded part totally covers the body of first ring 3. In another particular case, the insert moulded part partially covers the body of first ring 3, for example the portion of the body that is located in the extension of strap 7 starting from first edge 3 that defines slot 6 in the direction AA.

Figure 4:
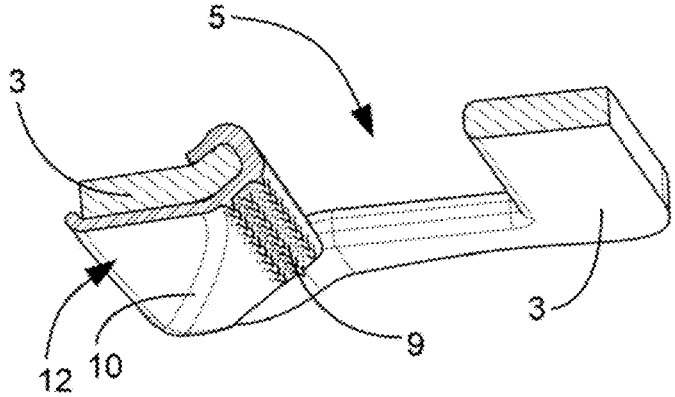
FIG. 4 schematically illustrates the textured area illustrated in FIG. 2, the textured area comprising gripping spikes formed in the bulk of the top ring and sinking into the strap.

In another embodiment, textured area 8 is formed by a removable part 10 fitted on the body of first ring 3. Such an embodiment is illustrated in FIG. 4. Removable part 10 is advantageously a part made from plastic. It is then possible to fit the plastic part comprising textured area 8 on a first ring which was initially devoid thereof. The removable part forms a support that at least partially covers the bottom surface of first ring 3 and forms a hook covering the inner edge and a part of the top surface. This configuration enables the support to be held in position by means of the stress applied by the strap on support 10.

It is particularly advantageous to form a textured area 8 that is offset from inner edge 3*a*. When textured area 8 is formed by gripping spikes 9, it is advantageous to have a flat inner edge 3*a* and to form rows of gripping spikes 9 arranged at a distance from inner edge 3*a*. For example, the patterns of the textured areas that are closest to edge 3*a* are at least 1 mm from the edge.

It is also advantageous to provide for textured area 8 to have several rows of patterns, for example gripping spikes, and preferentially for the first row of gripping spikes 9 to have a smaller height than the second row of gripping spikes 9. The first row of gripping spikes 9 separates inner edge 3*a* and the second row of gripping spikes 9. It is also advantageous to provide for the second row of gripping spikes 9 to be offset with respect to the first row of gripping spikes 9 in a direction perpendicular to the longitudinal direction of strap 7 which corresponds to the direction joining inner edge 3*a*, the first row of gripping spikes 9 and the second row of gripping spikes 9. By using a first row of patterns/gripping spikes 9 of smaller height, strap 7 can be adjusted more easily by making it slide without being hampered by the first patterns/gripping spikes 9.

As illustrated in FIG. 2, when strap 7 is stressed, the loop that passes around second ring 4 presses second ring 4 against the top surface of first ring 3 and presses strap 7 against the bottom surface of first ring 3 and against textured area 8. The friction induced by the textured area reduces or prevents sliding of strap 7 with respect to first ring 3 and therefore sliding of strap 7 inside the loop. It is no longer necessary to provide for strap 7 to be wedged between inner edge 3*a* and outer edge 4*b* nor is a strong force required.

In order to increase the pressure between the bottom surface of first ring 3 and strap 7, it is advantageous to form a first ring 3 that is curved and concave. In the illustrated embodiment, the body of first ring 3 extends in a first direction A that passes via the first end, textured area 8, first edge 3*a*, through hole 5 and the second end of the body, in that order. The second end of the body is fixed to harness 1 and/or strap 7. The curvature of the curved first end forces the strap to deform thereby ensuring the contact between the strap and the textured area.

In the embodiment illustrated in FIG. 2, strap 7 forms a closed loop that passes through the two through holes 5 to enable translational movement of first ring 3 with respect to second ring 4 and rotational movement of second ring 4 with respect to first ring 3. The closed loop surrounds the second end of the two rings 3 and 4.

The stress applied on strap 7 clamps strap 7 against textured area 8 and can close slot 6. The loop is in the clamped position.

As illustrated in FIG. 3, by performing rotation of the two rings 3/4 with respect to the attachment point of roping harness 1 defined by closed loop 11, strap 7 which is pressing on the outer edge leaves textured area 8 before leaving inner edge 3*a*. Once the rotation has been completed, the contact between strap 7 and textured area 8 is interrupted and the strap loop slides around second ring 4.

It is particularly advantageous for second ring 4 to have a smooth top surface as well as smooth and rounded inner and outer edges of the top surface to facilitate sliding of the strap on second ring 4.

By introducing a textured area 8 performing clamping of strap 7, it is advantageous to form smooth and rounded inner edges in order to avoid premature wear of the surface of strap 7. The top and/or bottom inner edge can present a radius of curvature that is at least equal to ⅙ of the thickness of first ring 3. Such a configuration makes clamping of strap 7 by means of slot 6 difficult in the absence of a textured area 8.

When first ring 3 is curved, it has at least one inflection area that separates at least a first portion and a second portion of the body. The first portion of the ring, preferably formed by the body, has textured area 8 or is designed to receive textured area 8. The first portion has a first bottom surface that defines textured area 8. The second portion is fixed to harness 1 or the other end of strap 7. Second ring 4 presses on the second portion.

It is advantageous for first ring 3 to define a V-shape or a U-shape and more particularly an inverted V-shape or U-shape with the inflection area forming the apex of the inverted V or U. The base of first ring 3 presses against the support area of harness 1 or against the user so that strap 7 separates first ring 3 and the support area or the user.

It is advantageous for the first portion to define a depression 12. Depression 12 is defined in the bottom surface to facilitate insertion of a finger enabling the two rings 3/4 to be made to rotate, for example to make the two rings 3/4 rotate around an axis of rotation formed by an outer edge 3*b* of first ring 3 at the second end. When rotation takes place, the force applied on the strap increases until the contact between strap 7 and the textured area is reduced or disappears. Once the threshold rotation value has been reached, the strap can slide with respect to the rings.

It is advantageous for first ring 3 to be of smaller dimension than second ring 4 and preferentially for the length of the second portion in the direction A to be smaller than the length of second ring 4 so that second ring 4 is only pressing on the second portion.

Strap 7 is devoid of predefined through holes and gripping spikes 9 are arranged immobile on first ring 3. The configuration is different from the one used in a belt loop where the effective length of the belt is predefined by the holes. The configuration according to the invention enables continuous adjustment of the effective length of strap 7.

The invention claimed is:

1. Device for adjusting and clamping a strap, comprising a first ring and a second ring superposed to define a slot for the strap to pass through, the second ring pressing on a top surface of the first ring, the slot for the strap to pass through being bounded by an outer edge of the second ring and an inner edge of the first ring, wherein the first ring and second ring are movable with respect to one another so that the slot for the strap to pass through is of variable thickness and the first and second rings are in a clamping position when the strap is tensioned or they are in a releasing position after a relative movement between the first and second rings causing the thickness of the slot for the strap to pass through to be increased, wherein a bottom surface of the first ring opposite the top surface of the first ring has a textured area provided with several salient elements designed to form an increased friction area between the strap and the bottom surface of the first ring, the textured area being separated from the outer edge of the second ring by the slot for the strap to pass through, and wherein the salient elements are formed on a support that is fitted removable with respect to the first ring.

2. Device for adjusting and clamping a strap according to claim 1, wherein the textured area has salient elements designed to sink into the strap.

3. Device for adjusting and clamping a strap according to claim 2, wherein the salient elements are located at a first distance from the inner edge, the first distance being not zero and less than twice the thickness of the first ring.

4. Device for adjusting and clamping a strap according to claim 1, wherein at least a part of the salient elements is formed by gripping spikes.

5. Device for adjusting and clamping a strap according to claim 1, wherein at least a part of the salient elements is formed in the bulk of the first ring.

6. Device for adjusting and clamping a strap according to claim 1, wherein at least a part of the salient elements is formed by a material insert moulded on the first ring.

7. Device for adjusting and clamping a strap according to claim 1, wherein the support at least partially covers the bottom surface of the first ring and forms a hook covering the inner edge and a part of the top surface.

8. Adjustment and clamping system comprising a device for adjusting and clamping a strap according claim 1 and a strap, wherein the height of the salient elements is less than or equal to twice the thickness of the strap.

9. Roping harness comprising an adjustment and clamping system according to claim 8.

* * * * *